US005788464A

United States Patent [19]

Gabelgaard

[11] Patent Number: 5,788,464

[45] Date of Patent: Aug. 4, 1998

[54] DOWNHOLE SUCTION PROCESS AND DEVICES

[76] Inventor: Keld Gabelgaard, Fichtenstrasse 8, D-71717 Beilstein, Germany

[21] Appl. No.: 624,435

[22] PCT Filed: Sep. 29, 1994

[86] PCT No.: PCT/EP94/03248

§ 371 Date: Jul. 19, 1996

§ 102(e) Date: Jul. 19, 1996

[87] PCT Pub. No.: WO95/09985

PCT Pub. Date: Apr. 13, 1995

[30] Foreign Application Priority Data

Oct. 1, 1993 [DE] Germany ..... 43 33 612.4

[51] Int. Cl.[6] ..... F04B 35/04

[52] U.S. Cl. ..... 417/76

[58] Field of Search ..... 417/70, 71, 72, 417/84, 54, 55, 76, 151, 160, 197; 15/359, 409, 421, 422, 300.1

[56] References Cited

U.S. PATENT DOCUMENTS

| | | | |
|---|---|---|---|
| 2,583,374 | 1/1952 | Hoffman | 417/84 X |
| 4,183,722 | 1/1980 | Roeder . | |
| 4,212,595 | 7/1980 | Kuintzle, Jr. et al. | 417/84 |
| 5,080,560 | 1/1992 | LeRoy et al. . | |

FOREIGN PATENT DOCUMENTS

| | | | |
|---|---|---|---|
| 2 279 956 | 7/1974 | France . | |
| 2 581 427 | 5/1985 | France . | |
| 2 581 427 a1 | 5/1985 | France . | |
| 2650864 | 2/1991 | France | 417/76 |
| 1 703 603 | 8/1974 | Germany . | |
| 3009 107 C2 | 8/1985 | Germany . | |
| 38 12 206 C2 | 4/1988 | Germany . | |
| 40 37 899 A1 | 11/1990 | Germany . | |
| 4037 899.3 | 11/1990 | Germany . | |
| 60-173400 (A) | 2/1984 | Japan . | |
| 1588924 | 8/1990 | U.S.S.R. | 417/76 |
| 1590668 | 9/1990 | U.S.S.R. | 417/76 |
| 2 219 351 | 3/1989 | United Kingdom . | |
| 2 261 030 | 5/1993 | United Kingdom . | |
| WO 95/09985 | 4/1995 | WIPO . | |

*Primary Examiner*—Ismael Izaguirre
*Attorney, Agent, or Firm*—Frohwitter

[57] ABSTRACT

The device and process for suction in a fluid medium are based on a special arrangement of a driver pump (2) and a jet pump (1) which preferably provide excellent suction with compact dimensions. The driver pump (2) supplies the fluid medium under pressure to the jet pump (1). The desired suction is obtained via an suction slot (3) in the jet pump (1). The driver pump (2) conveys the fluid medium required to operate the jet pump (1) via an inlet (9) which does not feed the suction slot (3).

20 Claims, 4 Drawing Sheets

DOWNHOLE SUCTION PROCESS AND DEVICES

FIELD OF THE INVENTION

The present invention involves a device for suction in a fluid medium and a process for suction in a fluid medium.

BACKGROUND OF THE INVENTION

In particular technical areas, suction devices that show strong suction behavior while immersed in a fluid are needed. It is often necessary that particles can also be sucked in. Water vacuum cleaner equipments applied to date are large in size that they are quite impeded under narrowly confined conditions. This is particularly true if narrow openings or borings should be vacuumed.

From the GB 2 219 351 A, a fuel pump is known with a primary outlet and a secondary outlet. The secondary pump outlet transports fuel under pressure through a nozzle to a tube to suck vapor and fuel through the tube in an upper chamber.

In the DE-PS 38 12 206, a device for cleaning wells is disclosed, which is operated through a pressurized driver pipe with a separation element that includes a jet pump, which is lowerable into a well.

A device is proposed in the DE-OS 40 37 899 for cleaning a well pipe and the filtering area in a water well consists of a well pipe with a hole or a slit and an operational area, as well as a suction/pressure pump and a pressure pump.

In SU-A-899 809, a water collecting well is disclosed, which is equipped with a pump system. The pump system includes a motor pump, which feeds a venturi tube, and suction and pumping tubes.

The FR-A-2 581 427 describes a jet pump that consists of minimum two parts, so that it can be brought to an operational place in a tube (Through Flow Lines Technic). The jet pump is surrounded by a ring-form area that serves to lead a driver medium.

The JP 60-173 400 suggests to produce a jet pump in a form of a main tube with a suction opening and a by-pass opening, where numerous high pressured water injection nozzles are arranged near the suction opening in the body of the tube.

SUMMARY OF THE INVENTION

The object of the present invention is to improve the above described situation, particularly to provide a possibility of suction that is suitable in special ways for tubes and elongated hollow areas, particularly in narrow combustion chambers and cooling systems.

The invention consists of a suction device with an arrangement of driver pump and jet pump and a process for suction, as defined in the claims.

BRIEF DESCRIPTION OF DRAWINGS

In the drawings, preferred embodiments of the invention are illustrated. They show.

DETAILED DESCRIPTION OF THE INVENTION

Figure 1:
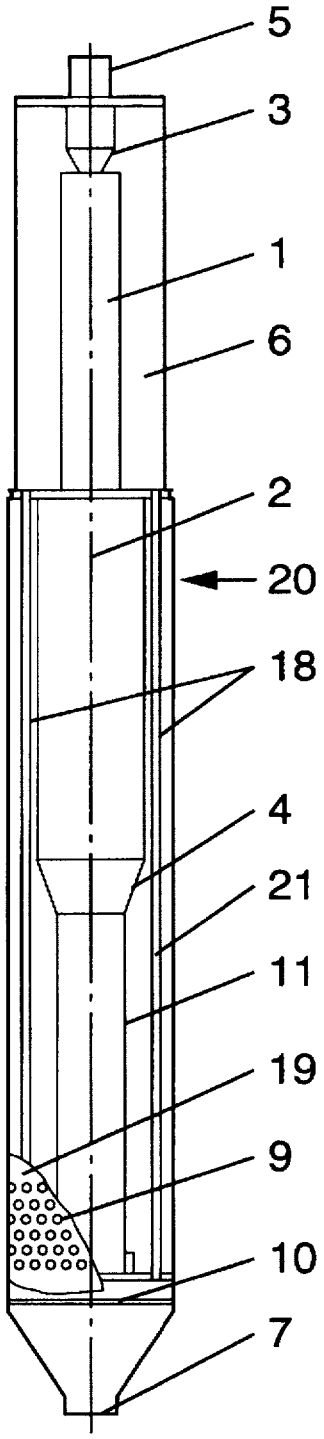
FIG. 1 a schematic sectional view of a device according to the present invention.

A preferred embodiment of the invention in a device, as presented in FIG. 1, includes a jet pump (1) that produces the desired suction effect on a suction gap (3). A driver pump (2) transports a fluid medium from outside of the device, e.g. water, to lead it under pressure of the jet pump (1). A conventional underwater pump, for example, like a mechanical rotor pump, preferably a pump with an electric motor gear, or a multistage pump can be placed as a driver pump (2). This way, the driver pump (2) has a separate inlet (9), which exclusively serves to supply the driver pump (2). The jet pump has a suction chamber (6), which surrounds the suction gap (3). Further, the jet pump (1) contains its own jet pump inlet (18), constructed by suction tubes (21), which is not intended for the driver pump (2). It serves to transport the created suction effect on the suction gap (3) in the suction chamber (6).

Additionally, a pressure joint (5) is intended as the common outlet for all the mediums transported by the driver pump (2) and sucked in by the jet pump (1). Preferably, a direct backflow of the discharging medium to the driver pump (2) through the pressure joint (5) does not exist. By the connection between driver pump (2) and jet pump (1), it preferably involves an open system that does not include a circulation. It is preferable that the device according to the present invention is immersed in a liquid medium, so that the driver pump (2) does not transport medium in gas form during the operation. However, the driver pump (2) can also be arranged in such a way that it is in a position to transport medium in gas form.

In a preferred embodiment of the invention, the jet pump inlet (18) of the jet pump (1) contains several inlets that transfer the suction effect from the suction gap (3) in the suction chamber (6) to the suction opening (7).

In a further embodiment, the jet pump inlet (18) is arranged in such a way that it contains one or more suction tubes (21).

It is preferred that a suction opening (7), e.g. as suction joint, is connected to the suction chamber (6) over the jet pump inlet (18). It is possible in this way, particularly if several inlets (e.g. suction tubes) are utilized for the rendering of the suction effect, to concentrate the suction effect. Preferably, 2 to 6 suction tubes (21) are used.

A preferred embodiment of the invention arranges the suction opening (7), assigned to the jet pump (1), on the opposite side of the pressure joint (5). This way, a particularly compact construction of the invention can be attained, particularly if the assigned driver pump inlet (9) of the driver pump (2) is laterally arranged. Particularly preferred is an elongated construction of the device, where a suction end of the device is separated and geometrically removed from the driver pump inlet (9) of the pump (2), although they are on the same end of the device. Therefore, it is particularly preferred to develop the suction end as the suction opening (7) of the jet pump (1) and to place it at the extreme end of the device. Through this way, suction can be applied in a medium, where particles have settled, without allowing appreciable amount of the particles to get into the driver pump (2) through the driver pump inlet (9).

Another embodiment additionally provides the suction opening (7), assigned to the jet pump (1), of the driver pump (2) with a sieve and a sieve plate (10), respectively. This can then prevent the sucking in of larger particles.

Furthermore, it is preferred to provide the driver pump (2) with a housing (20), which can also enclose the suction chamber (6) and the jet pump (1).

The housing (20) can have the function of a feeding (pumping) tube (19) that contains an driver pump inlet (9), which can also consist of several openings. The driver pump inlet (9) of the driver pump (2) can be placed axially or, particularly preferred, laterally as an inlet in a ring form.

It is preferred to provide the driver pump inlet (9) of the driver pump (2) with a sieve and a grid, respectively, so that parts of a particular size cannot enter the driver pump (2).

It is particularly preferred to develop the device elongated and to provide the pressure joint (5) on the driver pump inlet (9) of the driver pump (2) at the farther end of the device.

The preferable arrangement is to place thin suction tubes (21), which is assigned to the jet pump (1), along the driver pump (2). Through this way, a particularly compact, narrow construction can be achieved, which also allows a device according to the present invention to be particularly applied under narrowly confined conditions. Such employment conditions prevail, e.g., in a chamber of fuel element of a nuclear power plant.

Further preferred is to arrange the driver pump (2) and the jet pump (1) in a tube and as a tube, respectively. Preferred forms of design are therefore the cylindrical forms, preferably with a circular or polygonal, particularly with a quadric or hexagonal (preferably with equal sides), cross-section. Therefore, the device is particularly appropriate for the application on borings and elongated openings, like in borings of a chamber of fuel element of a nuclear power plant.

Also preferred is to particularly coaxially arrange the axis of the motor (11) of the driver pump (2), the rotor axis of rotation of the driver pump (2) and the direction of the main stream of the water pump in the same direction.

Also preferred is to lead the medium sucked in by the jet pump (1) through the suction gap (3) and to lead the medium transported by the driver pump (2) through filtrating devices (gravity applied deflector traps), flexible suction devices, and receiving devices for reusable materials.

Also preferred is the attachment of separators (e.g. hydrocyclone or filter) on the pressure side, i.e. on the pressure joint (5).

The described embodiments of the invention are particularly suitable to suck out and to suck in, respectively, solid bodies and to capture them at the device, because the preferred embodiment of the invention can exhibit very high suction effects. Preferably, the above described devices can be applied in the search and removal of disturbing objects present in channels or tubing systems, particularly in cooling systems of nuclear power plants.

The invention also includes a process for suction in a fluid medium that surrounds a device in an elongated or deep receptacle, pipe, shaft, hollow areas or similar sites. Here, the fluid medium is transported from outside the device and brought to a jet pump (1) of the device under pressure. Through the help of the transported fluid medium, a suction effect is generated at a suction gap (3) of the jet pump (1) arranged in the device. Thereby, a device of this type is constructed and placed in a receptacle, pipe, shaft, hollow areas or similar sites, such that the medium surrounding the device can be sucked in at the desired place. The transported fluid medium led to the jet pump under pressure and the medium sucked in by the suction gap (3) of the jet pump (1) is then led away.

In a particularly preferred embodiment of the process according to the present invention, the suction effect is produced at a suction gap (3) in a suction chamber (6) and is brought to one of the various places by the suction gap (3) for its application.

Also preferred is to allow the fluid medium, brought from outside of the device and led to the jet pump (1) under pressure, to be transported by a driver pump (2) arranged in the device. The fluid medium thus transported by the driver pump (2) flow through an inlet of the device, where the inlet does not serve to supply the medium via the suction gap (3) of the jet pump (1).

Particularly preferred is to lead away the fluid medium led in to the jet pump (1) under pressure and the medium sucked in by the suction gap (3) of the jet pump (1), without causing a direct backflow of the discharging medium into the device, especially to the driver pump (2). In this respect, an open system exists.

Further preferred is to transfer the suction effect from the suction gap (3) in the suction chamber (6) through a jet pump inlet (18) of the jet pump (1) to a desired place.

In a further embodiment of the process according to the present invention, it is intended to lead away the medium sucked in by the suction gap (3) of the jet pump (1) and the medium transported by the driver pump (2) together through a pressure joint (5).

Preferred is the use of the fluid medium transported by the driver pump (2) for the purpose of simultaneously cooling the motor (11) of the driver pump (2).

In a further embodiment of the process according to the present invention, the fluid medium that is to be sucked in contains material in forms of particles.

Preferred is a process, wherein the suction effect of the jet pump (1) is transferred from thin suction tubes (21) along the driver pump (2) to the place of the suction of the surrounding fluid medium. This way, a particularly compact and narrow construction can be preferably achieved.

In a further process, a compactly constructed device according to the present invention is used for suction under narrowly confined conditions.

The device according to the present invention can preferably be placed in an elongated and deep, respectively, hollow areas of a system for suction in borings. Also preferred is a process, wherein a device according to the present invention operates in a vertical working position from above or laterally or in a horizontal working position. This way, an intended suction of the walls surrounding the device can also take place.

Preferably, as a fluid medium, water and impurities are sucked in from a chamber of fuel elements of a nuclear power plant. Particularly preferred is a process according to the present invention, wherein radioactive particles are efficiently sucked in from a fluid medium and objects to be sucked in from surfaces, respectively, due to the suction effect of the jet pump.

Also preferred is to suck in, lead away, and to separate at the device, respectively, solid bodies in a fluid medium. Particularly preferred is to search for disturbing bodies, like metal parts, in channels, tubing systems and similar places and also in cooling systems of nuclear power stations, and to capture these through high suction effect.

FIG. 1 shows a specific embodiment of a device according to the present invention in a form of a cylindrical tube. A suction opening (7) of the jet pump (1) is arranged at the bottom end, where a sieve plate (10) is included for filtering out the larger particles and bodies, respectively. Thereon, thin suction tubes (21) are attached, which connect the suction opening (7) with a suction chamber (6) of the jet pump (1). The suction tubes (21) are arranged along a driver pump (2) to achieve a compact construction. This way, the suction tubes (21) have a distance from each other. This ensures that the fluid medium between the suction tubes (21) can reach the feed opening (4) of the driver pump (2). The suction chamber (6) surrounds the jet pump (1) with a suction gap (3). As an outlet, a pressure joint (5) is placed on the opposite side of the suction opening (7). A feeding (pumping) tube (19) surrounds the driver pump (2). This way, a number of lateral, sieve like openings are provided as driver pump inlet (9) of the driver pump (2) in the feeding tube to permit the inflow of a fluid medium. Thereby, the suction opening (7) is separated and geometrically removed from the driver pump inlet (9) of the driver pump (2), where the suction opening (7) is arranged at the farthest end of the device. The driver pump (2) feeds the jet pump (1), wherein the driver pump (2) does not lead the fluid medium via the suction gap (3). Means for a backflow of the fluid medium fed into the jet pump (1) for a further passage through the driver pump (2) are not provided.

FIG. 1 also describes clearly, the process of the suction in a liquid medium. The device presented in FIG. 1 is partly or preferably totally immersed in a fluid medium. The driver pump (2) transports the liquid medium, e.g. water, from outside of the device through the driver pump inlet (9) in the feeding tube (19). This water reaches between the suction tubes (18) into the feed opening (4) of the driver pump (2). The driver pump transports the water under pressure to the jet pump (1). The driver pump (2) can, for example, lead water with a pressure of 9 bar to the jet pump (1). After leaving the pressure joint (5), the outflowing water possesses, for example, a pressure of 3 bar. At the suction gap (3), a suction pressure can be produced to a near technical vacuum through a combination of jet and driver pumps known in the market. Therefore, the process according to the present invention allows to achieve a particularly distinctive suction behavior. The suction effect is transferred from the suction gap (3) in the suction chamber (6) through the suction tubes (18) to the suction opening (7). This way, for instance, water can be transported by the driver pump (2) at 20 $m^3/h$ and can be led to the jet pump (1), where the jet pump (1) draws water at ca. 10 $m^3/h$ via the suction gap (3).

Figure 2:
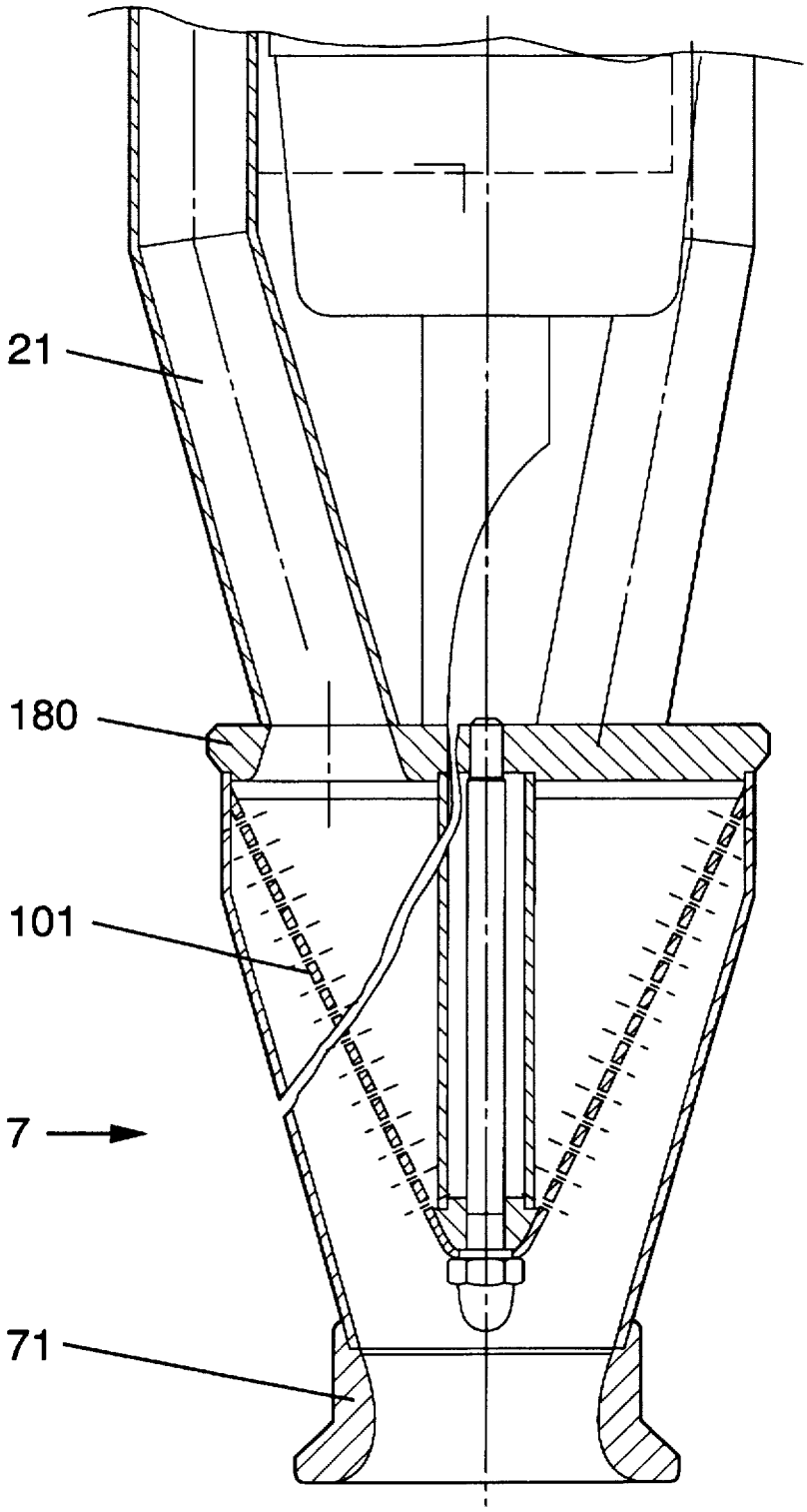
FIG. 2 a partial view, partly in section, of the suction portion of a device according to the present invention.

In FIG. 2, the suction opening (7) of the jet pump (1) (not shown in FIG. 2) of a device according to the present invention is presented. Through the suction tubes (21), the suction opening (7) is connected with the suction chamber (6) (not shown in FIG. 2) of the jet pump (1). Openings in the plate (180), covering the suction opening (7), are provided for the suction tubes (21). The suction opening (7) is supplied with a mouth (71) a sieve (101) as provided between the mouth (71) and the plate (180).

Figure 3:
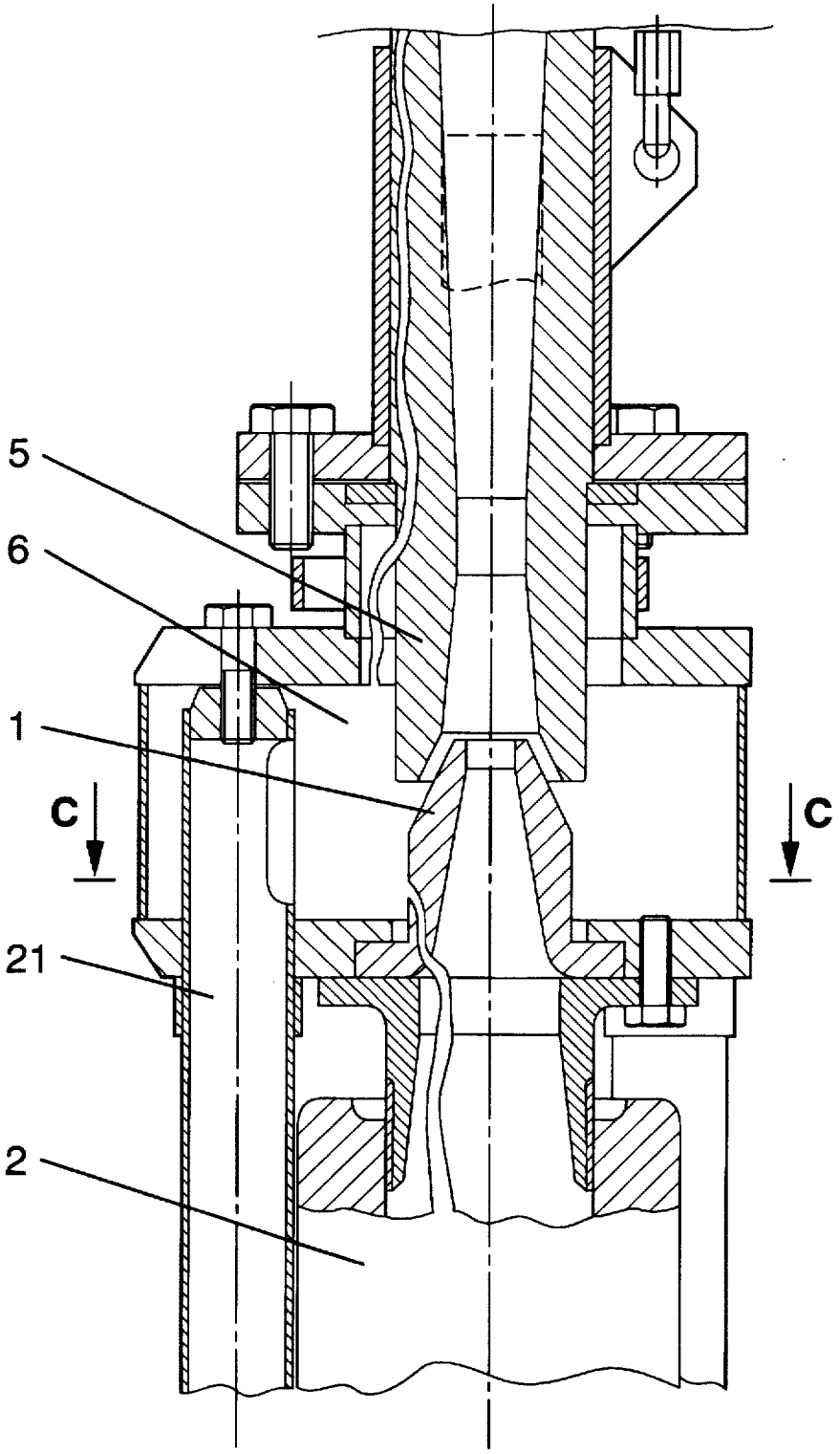
FIG. 3 a partial view, partly in section, of the jet pump portion of a device according to the present invention.

FIG. 3 shows a sectional view of a device according to the present invention. In this example, suction tubes (21) are provided that possess an opening leading to the suction chamber (6) of the jet pump (1). The jet pump (1) is connected to the driver pump (2) on one end and to the pressure joint (5) on the other end.

Figure 4:
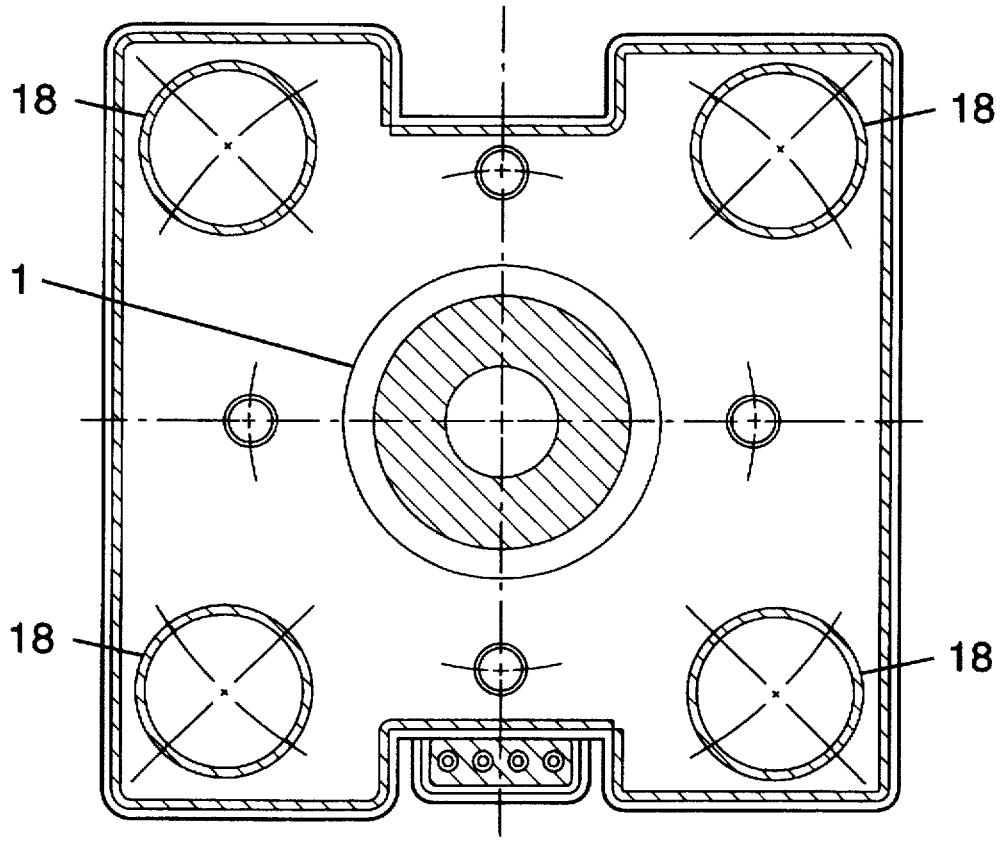
FIG. 4 a sectional view of the device shown in FIG. 3 along C—C.

FIG. 4 is a cross sectional view of an embodiment of the invention taken at line CC of FIG. 3. FIG. 4 shows that the device presented in FIG. 3 has a rectangular form. The illustrated device contains four suction tubes (18) the jet pump (1) is located in the middle of the device.

Devices and processes according to the present invention can be preferably applied for suction in fluid mediums, particularly if high suction effect and/or compact dimensions are necessary, e.g. for suction in borings and hollow areas. The device with the separation and filtering devices, respectively, described above can be applied to filter out particles or other, perhaps, reusable materials on the suction or drawing side and/or on the pressure side. A further preferred application lies in the area of cleaning a chamber of fuel elements of a nuclear power plant, wherein according to the present invention, strong suction effects in narrow openings or borings can be obtained to achieve a very effective cleaning.

The same applies to channel and pipe systems.

List of reference marks 1 jet pump
2 driver pump
3 suction gap
4 feed opening
5 pressure joint
6 suction chamber
7 suction opening
9 driver pump inlet
10 sieve plate
11 motor
18 jet pump inlet
19 feeding (pumping) tube of the driver pump (2)
20 housing
21 suction tubes
101 sieve
180 plate

I claim:

1. Suction device for the suction of a fluid medium through a suction opening with a jet pump and with a driver pump, characterized in that the jet pump (1) and the driver pump (2) in the suction device are arranged axially successively, a suction chamber (6) is provided, which surrounds a suction gap (3) of the jet pump (1), the suction chamber (6) is connected with the suction opening (7) through numerous suction tubes (18), and the inlet (9) of the driver pump is arranged in a place spatially separate from the suction opening (7).

2. Device according to claim 1, wherein the fluid medium is sucked through walls surrounding the device.

3. Device according to claim 1, wherein the driver pump and an operating motor of the driver pump are arranged between the suction opening and the jet pump.

4. Device according to claim 1, wherein the suction opening comprises a sieve plate.

5. Device according to claim 1, wherein the driver pump and the jet pump are arranged in a housing.

6. Device according to claim 1, wherein the suction tubes are arranged along the driver pump, wherein the device has a compact, narrow construction.

7. Device according to claim 5, wherein the housing is shaped in a tube form.

8. Device according to claim 1, wherein the device is elongated, wherein the inlet of the driver pump is arranged in the area of one end of the device, and wherein the suction opening of the device is arranged on the same end of the device though separated and geometrically removed from the inlet of the driver pump, and wherein the suction opening is arranged at the farthest end of the device.

9. Device according to claim 1, wherein the construction of the device is elongated and a pressure joint is arranged at the end of the device distant from the inlet of the driver pump.

10. Device according to claim 1, wherein the inlet of the driver pump is constructed sieve like and grid like, respectively, so that particles of a particular size cannot enter into the driver pump.

11. Device according to claim 1, wherein the driver pump, an operating motor of the driver pump and the jet pump are coaxially arranged.

12. Device according to claim 1, wherein the medium sucked in by the jet pump through the suction gap and the medium transported by the driver pump is passed through a collecting means for reusable materials.

13. Device according to claim 1, wherein the medium sucked in by the jet pump through the suction gap and the medium transported by the driver pump is passed through a separating means for reusable materials.

14. Process for suctioning a fluid medium surrounding a device arranged in a suction site, said process comprising:

(a) transporting a first portion of the fluid medium from outside the device and delivering the first portion of the fluid medium under pressure to a jet pump of the device, (b) sucking a second portion of the fluid medium, through the help of the transported first portion of the fluid medium, at a suction gap of the jet pump arranged in the device, wherein a suction effect is produced at the suction gap in a suction chamber and is brought to one of various places by the suction gap for its application, wherein the device is constructed in such a way and is arranged in a suction site so that the medium surrounding the device is sucked in at a desired place, (c) leading away the first portion of the fluid medium transported to the jet pump under pressure and of the second portion of the fluid medium sucked in by the suction gap of the jet pump, wherein the first portion of the fluid medium, transported from outside of the device and led in to the jet pump under pressure, is pumped by a driver pump arranged in the device, wherein this first portion of the fluid medium is pumped by the driver pump through an inlet means of the device, wherein the inlet means does not supply the second portion of the fluid medium which flows through the suction gap of the jet pump.

15. Process according to claim 14, wherein the first portion of the fluid medium led to the jet pump under pressure and the second portion of the fluid medium sucked in by the suction gap of the jet pump are led away without causing a direct backflow in the device.

16. Process according to claim 14, further comprising transferring the suction effect from the suction gap through a suction chamber and through the inlet means of the jet pump connected to a desired place.

17. Process according to claim 14, wherein said leading away of the second portion of the fluid medium sucked in by the suction gap of the jet pump and the first portion of the fluid medium transported by the driver pump is thorough a pressure joint.

18. Process according to claim 14, further comprising cooling an operating motor of the driver pump with the first portion of the fluid medium transported by the driver pump.

19. Process according to claim 14, wherein the fluid medium contains materials in particle form.

20. Process according to claim 14, further comprising transferring the suction effect of the jet pump from thin suction tubes along the pump, wherein a compact, narrow construction is achieved, to the place of the suction of the surrounding fluid medium.

* * * * *